US007444905B2

(12) United States Patent
Hu

(10) Patent No.: US 7,444,905 B2
(45) Date of Patent: Nov. 4, 2008

(54) WRENCH WITH REINFORCED HOLLOW HANDLE

(76) Inventor: Bobby Hu, 16F-2, No. 367, Gong Yi Road, West District, Taichung (TW)

( * ) Notice: Subject to any disclaimer, the term of this patent is extended or adjusted under 35 U.S.C. 154(b) by 0 days.

(21) Appl. No.: 11/675,757

(22) Filed: Feb. 16, 2007

(65) Prior Publication Data

US 2008/0098859 A1 May 1, 2008

(30) Foreign Application Priority Data

Oct. 26, 2006 (TW) ..... 95218961 U
Dec. 8, 2006 (TW) ..... 95146163 A
Jan. 5, 2007 (TW) ..... 96100587 A

(51) Int. Cl.
*B25B 23/16* (2006.01)

(52) U.S. Cl. ..... 81/177.4; 81/490

(58) Field of Classification Search ..... 81/177.1, 81/177.4, 489, 490, 492
See application file for complete search history.

(56) References Cited

U.S. PATENT DOCUMENTS

| | | | | |
|---|---|---|---|---|
| 32,106 | A | 4/1861 | Martin | 81/177.1 |
| 287,809 | A | 11/1883 | Devereux | 81/436 |
| 360,426 | A | 4/1887 | Fray | 81/177.1 |
| 2,023,131 | A | 12/1935 | James | 473/318 |
| 2,027,922 | A | 1/1936 | McNaught | 72/325 |
| 2,057,440 | A | 10/1936 | Marcy et al. | 72/364 |
| 2,165,991 | A | 7/1939 | West | 76/106 |
| 2,577,651 | A | 12/1951 | Dewey | 81/177.4 |
| 2,623,418 | A | 12/1952 | Vaughan | 76/114 |
| 2,680,984 | A | 6/1954 | Ingwer | 81/101 |
| 4,272,332 | A | 6/1981 | Probost | 205/122 |
| 4,570,515 | A | 2/1986 | Yang | 81/166 |
| 4,627,315 | A | 12/1986 | Lin | 81/177.4 |
| 4,848,195 | A | 7/1989 | Hockenbery | 81/176.2 |
| 4,926,721 | A | 5/1990 | Hsiao | 81/177.4 |
| 5,148,724 | A | 9/1992 | Rexford | 81/60 |
| 5,375,449 | A | 12/1994 | Bononi | 72/370.03 |
| 5,522,287 | A | 6/1996 | Chiang | 81/60 |
| 5,638,727 | A | 6/1997 | Gringer | 81/438 |
| 5,943,924 | A | 8/1999 | Jarvis | 81/177.2 |
| 6,070,499 | A | 6/2000 | Wisbey | 81/57.29 |
| 6,148,482 | A | 11/2000 | Maraman, Jr. | 81/177.1 |
| 6,161,454 | A | 12/2000 | Chaconas | 81/63.2 |
| 6,263,766 | B1 | 7/2001 | Jarvis | 81/60 |
| 6,324,947 | B2 | 12/2001 | Jarvis | 81/177.2 |
| 6,477,759 | B2 | 11/2002 | Hu | 29/527.2 |
| 6,571,669 | B2 * | 6/2003 | Benatz et al. | 81/177.4 |
| 6,647,834 | B2 | 11/2003 | Hu | 81/119 |
| 6,659,997 | B1 | 12/2003 | Casutt | 60/61 |
| 6,684,738 | B2 * | 2/2004 | Huang | 81/60 |

(Continued)

FOREIGN PATENT DOCUMENTS

| | | |
|---|---|---|
| TW | 153538 | 3/1980 |

*Primary Examiner*—Jacob K Ackun, Jr.
(74) *Attorney, Agent, or Firm*—Alan Kamrath; Kamrath & Associates PA

(57) ABSTRACT

A wrench includes a head portion, a handle portion, and a neck portion between the head portion and the handle portion. The handle portion is hollow and includes a front portion contiguous to the neck portion and a rear portion to be gripped by a user. The front portion has a wall thickness greater than that of the rear portion.

16 Claims, 15 Drawing Sheets

U.S. PATENT DOCUMENTS

| | | | | |
|---|---|---|---|---|
| 7,171,874 | B1 | 2/2007 | Huang | 81/177.4 |
| 7,258,046 | B2 | 8/2007 | Fruhm et al. | 81/177.4 |
| 2001/0001892 | A1 | 5/2001 | Hu | 29/527.2 |
| 2002/0035899 | A1 | 3/2002 | Peters | 81/177.4 |
| 2002/0174748 | A1 | 11/2002 | Peters | 81/177.4 |
| 2003/0154825 | A1 | 8/2003 | Huang | 81/60 |
| 2004/0020330 | A1* | 2/2004 | Hu | 81/177.1 |
| 2005/0102810 | A1 | 5/2005 | Hu | 29/90.01 |

* cited by examiner

WRENCH WITH REINFORCED HOLLOW HANDLE

BACKGROUND OF THE INVENTION

The present invention relates to a wrench with a hollow handle. More particularly, the present invention relates to a wrench with a reinforced hollow handle.

Wrenches are widely used in daily life. FIG. 14 illustrates a conventional wrench including a head 1, a neck 2, and a handle 3. The head 1, the neck 2, and the handle 3 are integrally formed by forging and have a solid structure, which results in high manufacturing cost and a heavy wrench. The solid handle 3 is the largest element of the wrench and, thus, a burden to the user, which may lead to low working efficiency.

FIG. 15 illustrates another conventional wrench of the type having a head 5, a neck 9, and a hollow handle 4 to reduce the overall weight of the wrench and to cut the manufacturing cost. However, the wrench cannot withstand large torque. Specifically, the hollow handle 4 includes a joint portion 6 having a smaller outer diameter and connected with the neck 9, a gripping portion 7 having a larger outer diameter, and a necking portion 8 between the joint portion 6 and the gripping portion 7. The gripping portion 7, the necking portion 8, and the joint portion 6 have identical wall thicknesses. However, the joint area between the joint portion 6 and the necking portion 8 are liable to break due to torque and shear force generated during driving a fastener.

The present invention is intended to provide a wrench with a reinforced hollow handle portion to withstand larger torque during operation while having a reduced overall weight without significantly increasing the manufacturing cost.

BRIEF SUMMARY OF THE INVENTION

The present invention solves this need and other problems in the field of wrenches by providing, in a preferred form, a hollow handle having a reinforced structure. A wrench according to the preferred teachings of the present invention includes a head portion, a handle portion, and a neck portion between the head portion and the handle portion. The handle portion is hollow and includes a front portion contiguous to the neck portion and a rear portion adapted to be gripped by a user. The front portion has a wall thickness greater than that of the rear portion.

In a preferred form, the handle includes a necking portion between the front and rear portions. The necking portion has a wall thickness greater than that of the rear portion and smaller than that of the front portion. The necking portion includes a small gradient section having a rear end contiguous to the rear portion and a larger gradient section having a rear end contiguous to a front end of the small gradient section. A front end of the larger gradient section is contiguous to the front portion of the handle portion. The small gradient section includes an outer periphery having a first tapering gradient from a rear end thereof to a front end thereof. The larger gradient section includes an outer periphery having a second tapering gradient from a rear end thereof to a front end thereof. The second tapering gradient is greater than the first tapering gradient. The small gradient section has a wall thickness greater than that of the rear portion. The larger gradient section has a wall thickness greater than that of the small gradient section and smaller than that of the front portion. In the most preferred form, the small gradient section has increased wall thickness from the rear end thereof toward the front end thereof, and the larger gradient section has increased wall thickness from the rear end thereof toward the front end thereof. The small gradient section has an outer diameter greater than that of the rear portion, and the larger gradient section has an outer diameter greater than that of the small gradient section and smaller than that of the front portion.

In a preferred form, an outer cover is mounted around the rear portion of the handle portion.

In another preferred form, the rear portion of the handle portion includes a rear end opening, and a cap is mounted to and covering the rear end opening.

In a further preferred form, the rear portion of the handle portion includes an open rear end defining a rear end opening, and an annular extension extends rearward and radially inward from a circumference of the rear end and defining a hole. A cap is mounted to and covers the hole of the annular extension.

In still another preferred form, the neck portion includes a groove in an end face thereof and in communication with an interior of the hollow handle portion.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
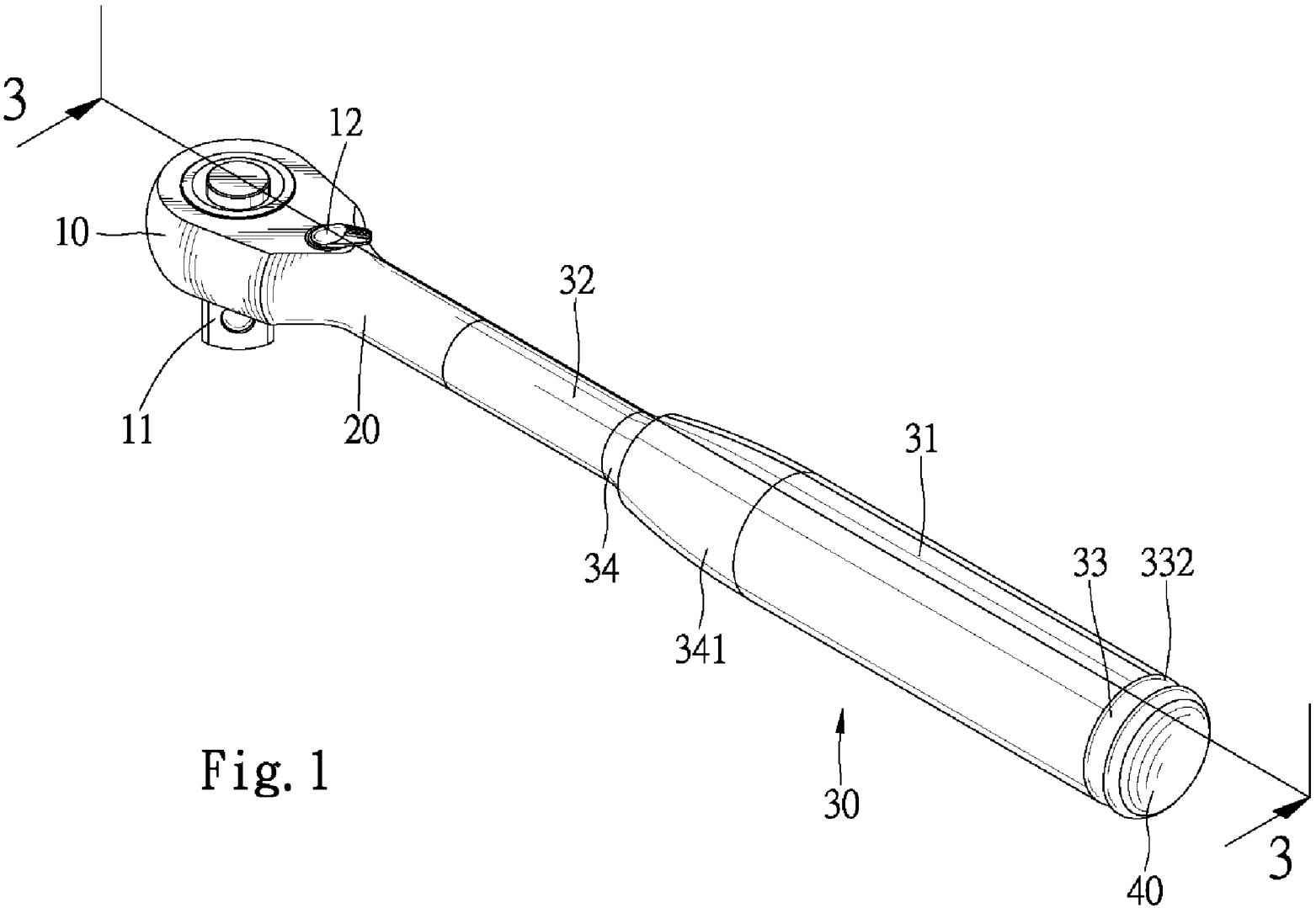
FIG. 1 is a perspective view illustrating a first embodiment of a wrench according to the preferred teachings of the present invention.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "front", "rear", "end", "portion", "section", "radial", "annular", "rearward", "inward", "circumference", "thickness", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

Figure 2:
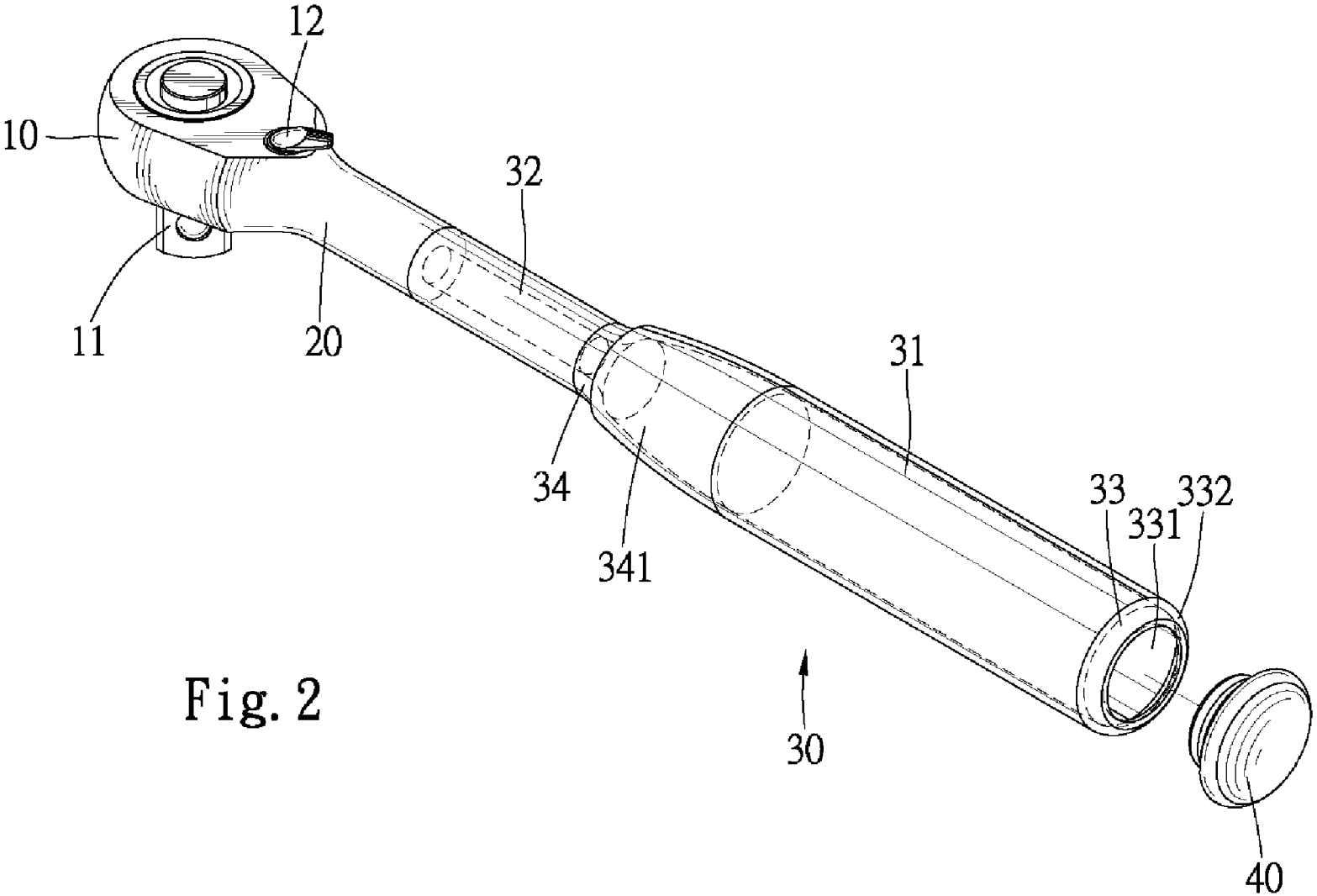
FIG. 2 is an exploded perspective view of the wrench of FIG. 1.
Figure 3:
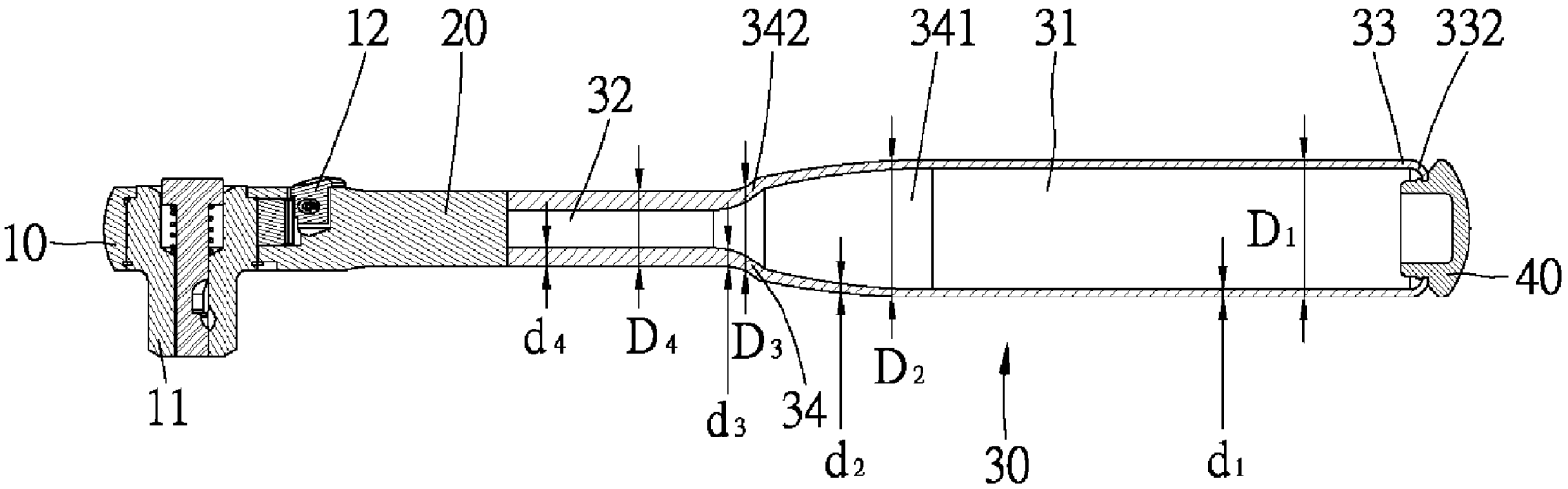
FIG. 3 is a sectional view taken along plane 3-3 in FIG. 1.

A first embodiment of a wrench according to the preferred teachings of the present invention is shown in FIGS. 1 through 3 and includes a head portion 10, a handle portion 30, and a neck portion 20 between the head portion 10 and the handle portion 30. A driving device 11 and a switching device 12 are mounted to the head portion 10. The head portion 10 tapers toward the neck portion 20. In the illustrated embodiment, the neck portion 20 includes a front, larger end contiguous to the head portion 10 and a rear, smaller end contiguous to the handle portion 30. The neck portion 20 and the head portion 10 are integral and can be made by forging.

The handle portion 30 is hollow and includes a front portion 32 having a front end contiguous to the neck portion 20, a rear portion 31 adapted to be gripped by a user, and a necking portion 34 between a rear end of the front portion 32 and the rear portion 31. In the preferred form shown, the front end 32 has an outer diameter D4 the same as that of the rear end of the neck portion 20. The front portion 32 and the neck portion 20 may be joined together by friction welding or other suitable methods. The front portion 32 has a wall thickness d4 greater than that of the necking portion 34, which, in turn, is greater than the wall thickness d1 of the rear portion 31. In the preferred form shown, the necking portion 34 includes a small gradient section 341 having a rear end contiguous to the rear portion 31 and a front end. The necking portion 34 further includes a larger gradient section 342 having a rear end contiguous to the front end of the small gradient section 341 and a front end contiguous to rear end of the front portion 32 of the handle portion 30. The small gradient section 341 includes an outer periphery having a first tapering gradient from a rear end thereof to a front end thereof. The larger gradient section 342 includes an outer periphery having a second tapering gradient from a rear end thereof to a front end thereof. The second tapering gradient is greater than the first tapering gradient. In the most preferred form, the small gradient section 341 has a wall thickness d2 greater than the wall thickness d1 of the rear portion 31, and the larger gradient section 342 has a wall thickness d3 greater than the wall thickness d2 of the small gradient section 341 and smaller than the wall thickness d1 of the front portion 32. The small gradient section 341 has increased wall thickness d2 from the rear end thereof toward the front end thereof. The larger gradient section 342 has increased wall thickness d3 from the rear end thereof toward the front end thereof. In the preferred form shown, the wall thickness d4 of the front portion 32 is two times of the wall thickness d1 of the rear portion 31. Furthermore, the small gradient section 341 has an outer diameter D2 lesser than the outer diameter D1 of the rear portion 31, the larger gradient section 342 has an outer diameter D3 lesser than the outer diameter of the small gradient section 341, and the front portion 32 has an outer diameter D4 lesser than the outer diameter D3 of the larger gradient section 342.

The hollow handle 30 according to the preferred teachings of the present invention has enhanced structural strength to withstand larger torque and shear force during operation of the wrench without sacrificing the advantages of low weight and low manufacturing cost of the wrench. This is due to the increased wall thicknesses d1-d4 from the rear portion 31 toward the front portion 32 of the handle portion 30. Breakage of the handle portion 30 at the necking portion 34 is less likely to occur although the wall thickness of the necking portion 34 is smaller than the wall thickness d4 of the front portion 32. Furthermore, the larger gradient section 342 and the small gradient section 341 provide a smooth contour while reducing concentration of stress.

In the preferred form shown, the handle 30 includes a hollow interior extending from the rear portion 31 through the front portion 32. The rear portion 31 of the handle portion 30 includes an open rear end 33 defining a rear end opening, and an annular extension 332 extends rearward and radially inward from a circumference of the rear end 33 and defining a hole 331 in communication with the hollow interior of the handle portion 30. The annular extension 332 avoids undesired radially inward depression of the rear end 33 of the handle portion 30 resulting from a holding force applied by the user's hand. The hollow handle portion 30 may receive articles such as bits, fasteners such as bolts, nuts, screws or the like, and a cap 40 can be mounted to and cover the hole 331 of the annular extension 332 to further increase the structural strength of the rear end 33 of the handle portion 30 while avoiding the articles from falling out of the hollow handle 30.

Figure 4:
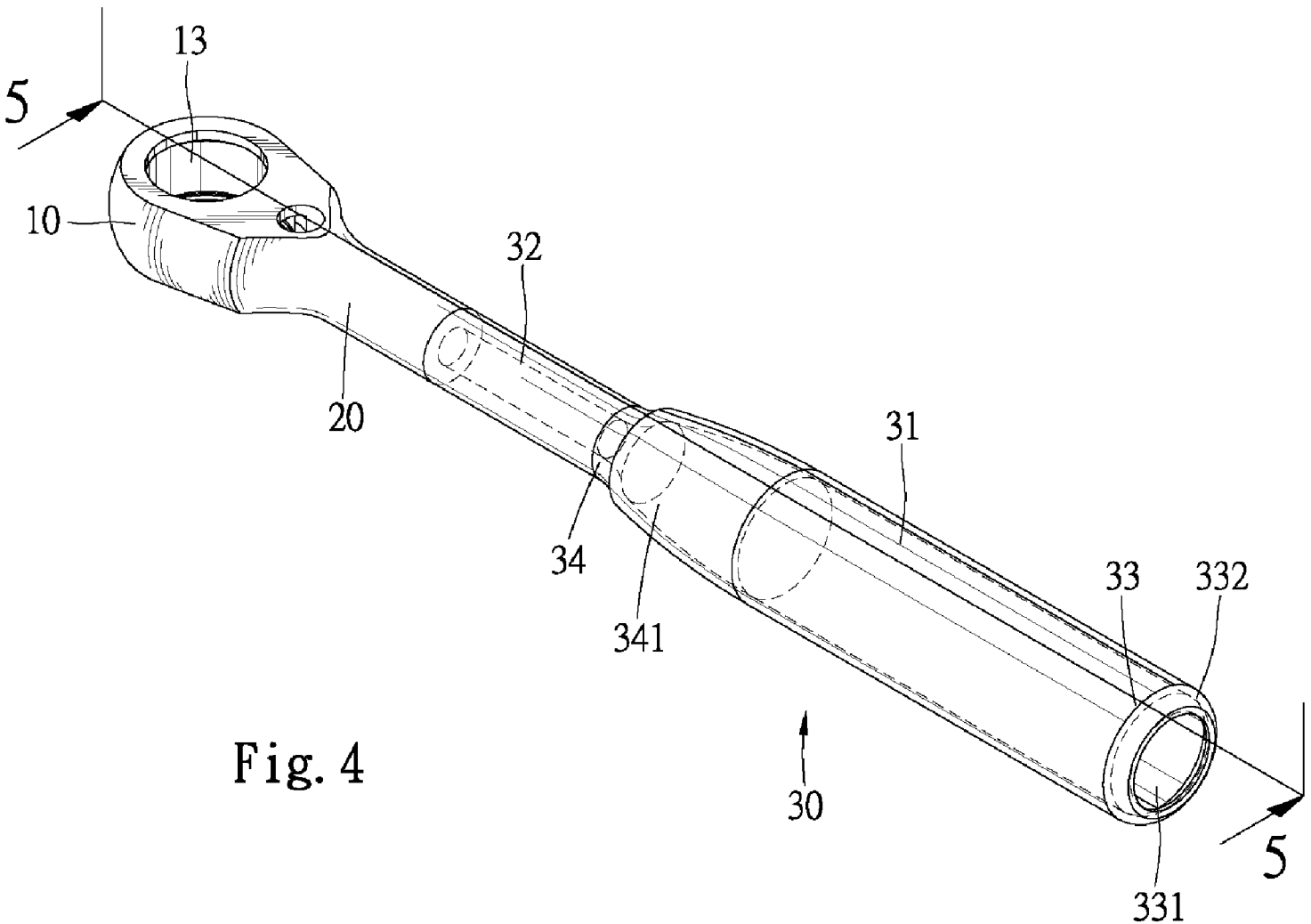
FIG. 4 is a perspective view illustrating a second embodiment of the wrench according to the preferred teachings of the present invention.
Figure 5:
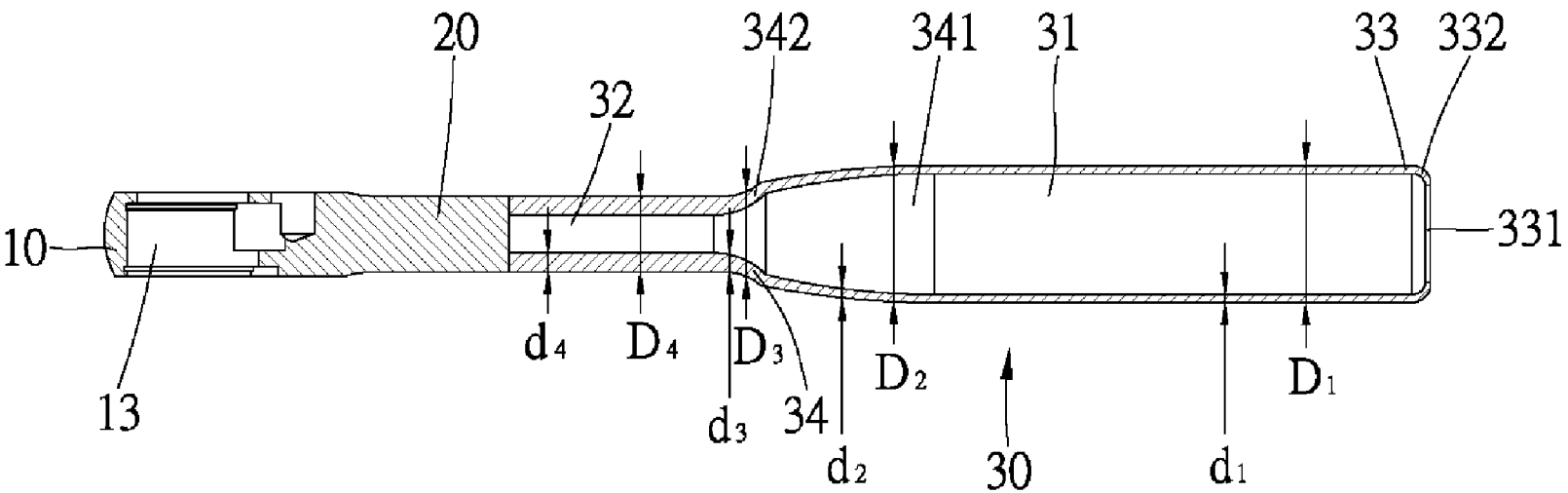
FIG. 5 is a sectional view taken along plane 5-5 in FIG. 4.

FIGS. 4 and 5 illustrate a second embodiment of the wrench according to the preferred teachings of the present invention, wherein the head portion 10 of the wrench is in the form having a compartment 13 for receiving a gear wheel or the like.

Figure 6:
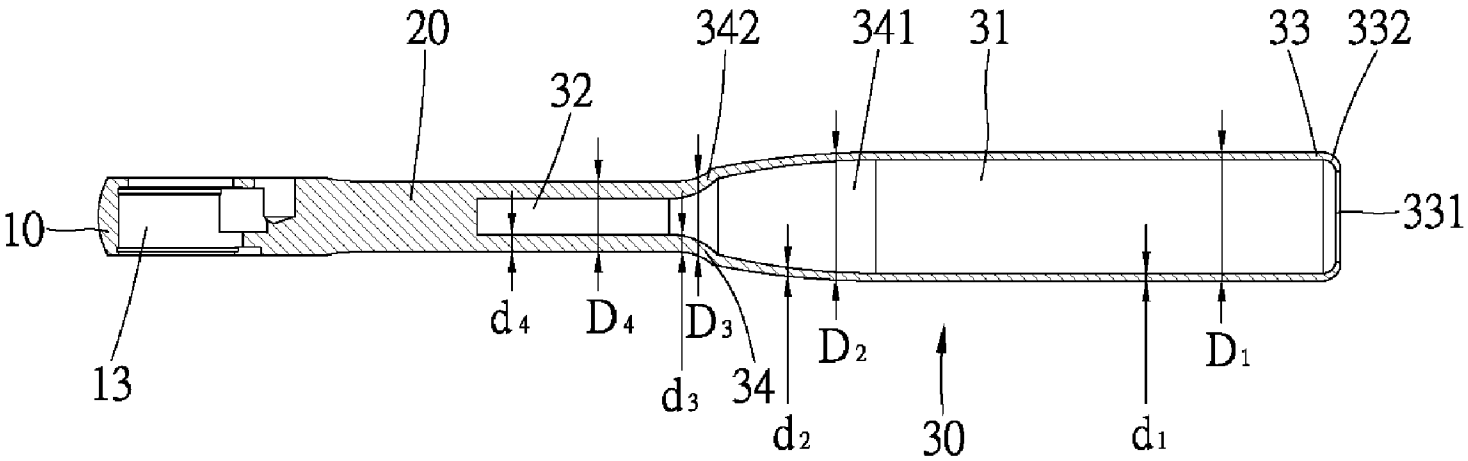
FIG. 6 is a sectional view illustrating a third embodiment of the wrench according to the preferred teachings of the present invention.

FIG. 6 illustrates a third embodiment of the wrench according to the preferred teachings of the present invention, wherein the head portion 10, the neck portion 20, and the handle portion 30 are integrally formed.

Figure 7:
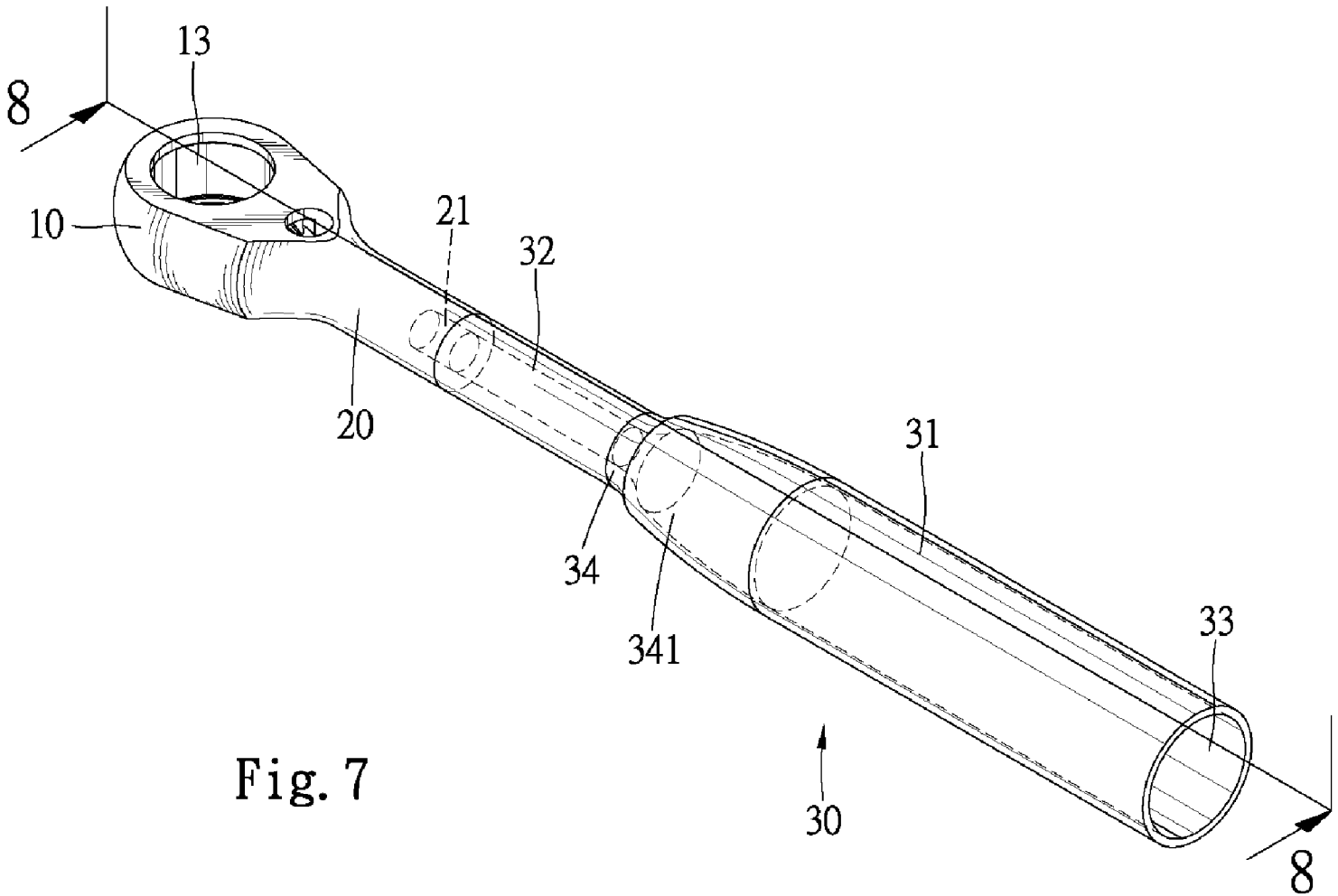
FIG. 7 is a perspective view illustrating a fourth embodiment of the wrench according to the preferred teachings of the present invention.
Figure 8:
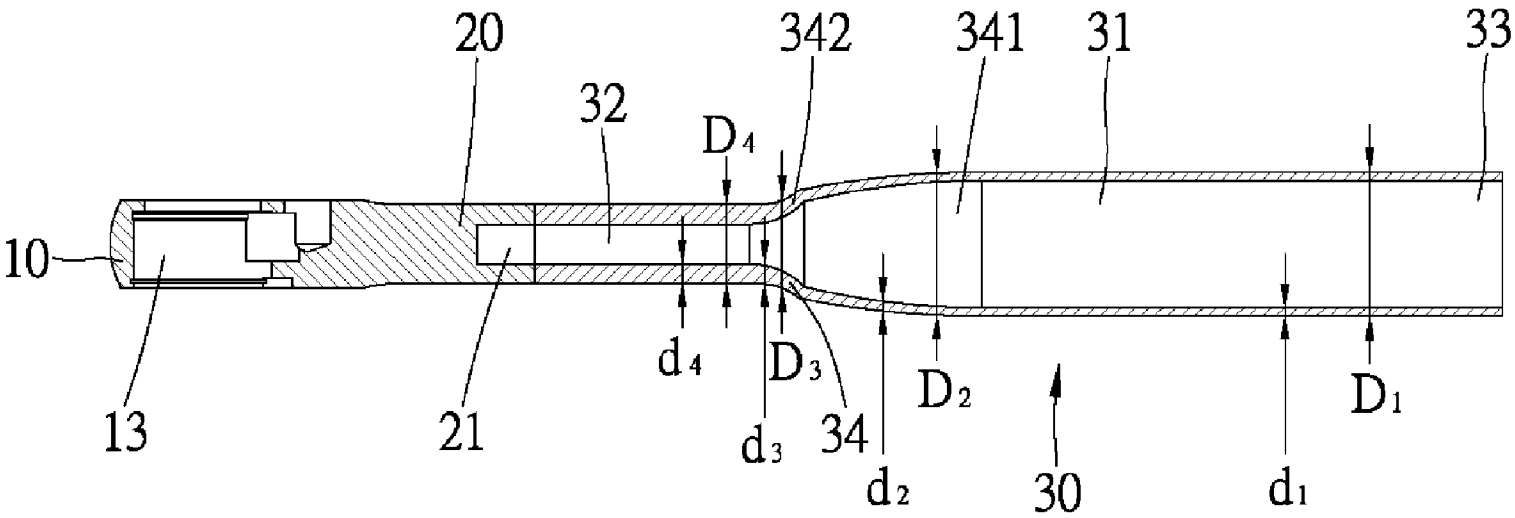
FIG. 8 is a sectional view taken along plane 8-8 in FIG. 7.

FIGS. 7 and 8 illustrate a fourth embodiment of the wrench according to the preferred teachings of the present invention modified from the second embodiment shown in FIGS. 4 and 5, wherein the annular extension 332 in the second embodiment is omitted from the rear end 33 of the handle portion 30. Furthermore, the neck portion 20 includes a groove 21 in an end face thereof and in communication with the hollow interior of the hollow handle portion 30.

Figure 9:
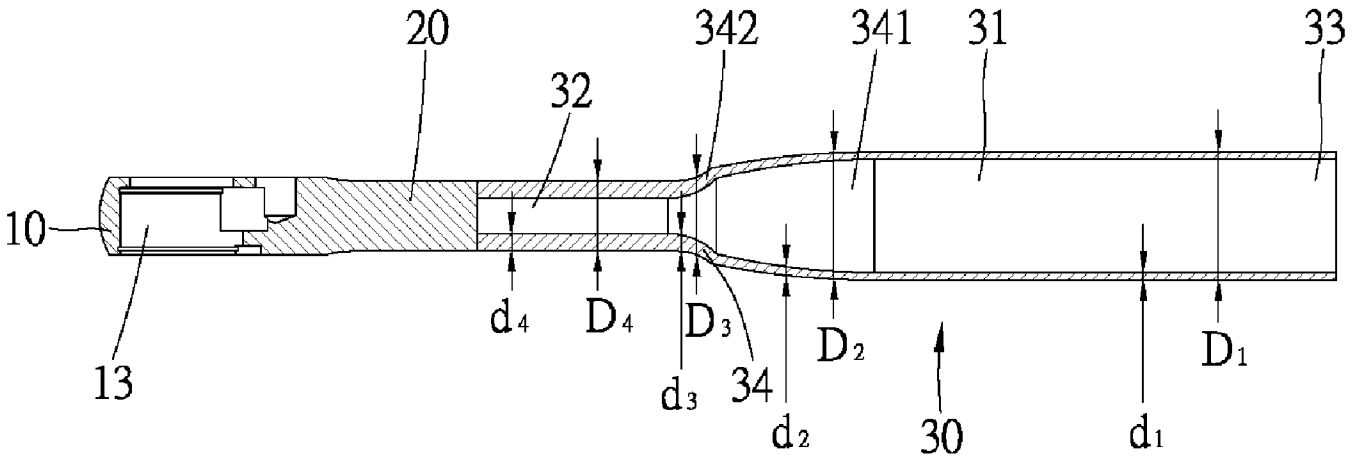
FIG. 9 is a sectional view illustrating a fifth embodiment of the wrench according to the preferred teachings of the present invention.

FIG. 9 is a sectional view illustrating a fifth embodiment of the wrench according to the preferred teachings of the present invention modified from the fourth embodiment shown in FIGS. 7 and 8, wherein the neck portion 20 has no groove.

Figure 10:
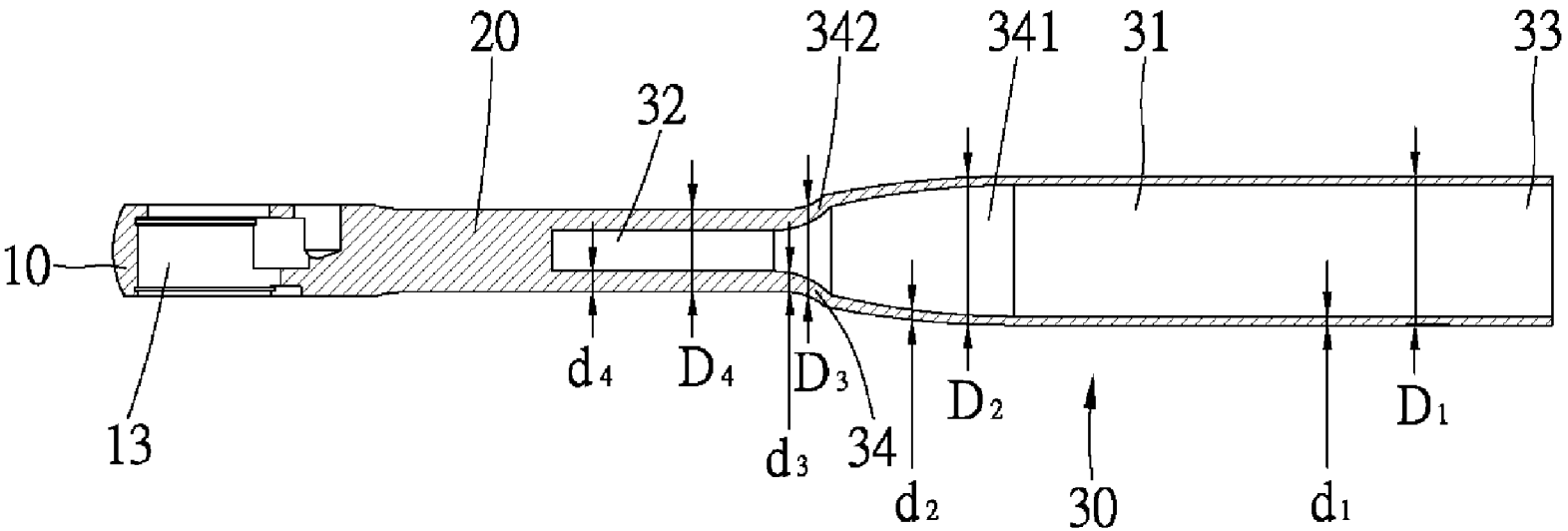
FIG. 10 is a sectional view illustrating a sixth embodiment of the wrench according to the preferred teachings of the present invention.

FIG. 10 is a sectional view illustrating a sixth embodiment of the wrench according to the preferred teachings of the present invention modified from the fifth embodiment shown in FIG. 9, wherein the head portion 10, the neck portion 20, and the handle portion 30 are integrally formed.

Figure 11:
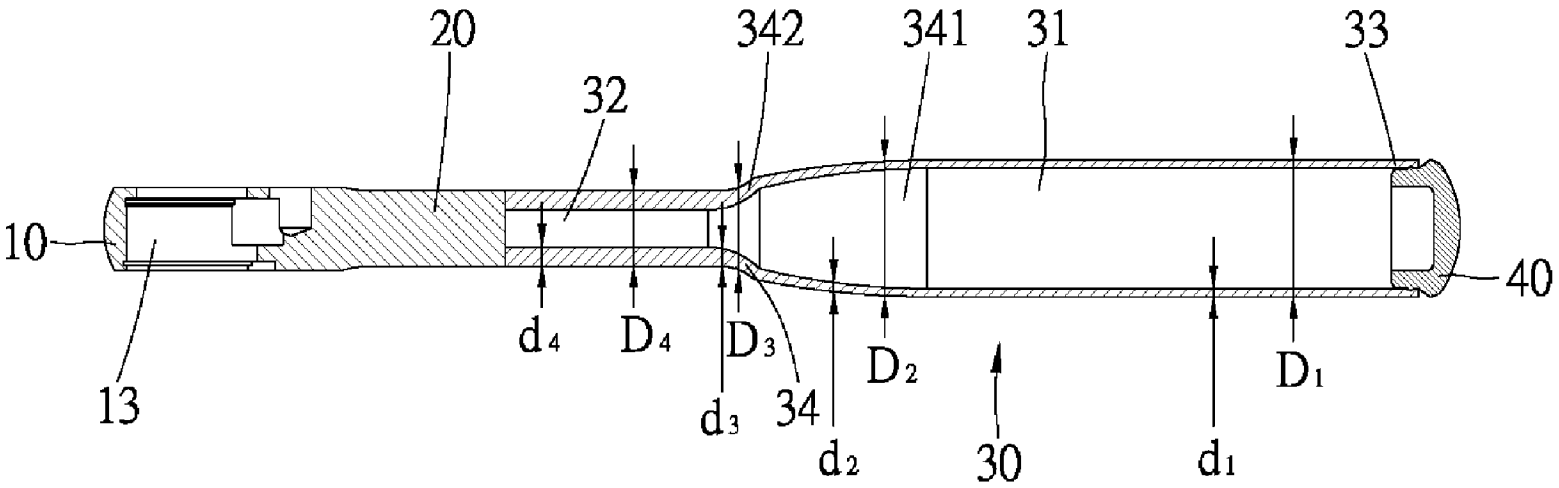
FIG. 11 is a sectional view illustrating a seventh embodiment of the wrench according to the preferred teachings of the present invention.

FIG. 11 is a sectional view illustrating a seventh embodiment of the wrench according to the preferred teachings of the present invention modified from the fifth embodiment shown in FIG. 9, wherein a cap 40 is mounted to and covers the rear end opening defined by the rear end 33 of the hollow handle portion 30.

Figure 12:
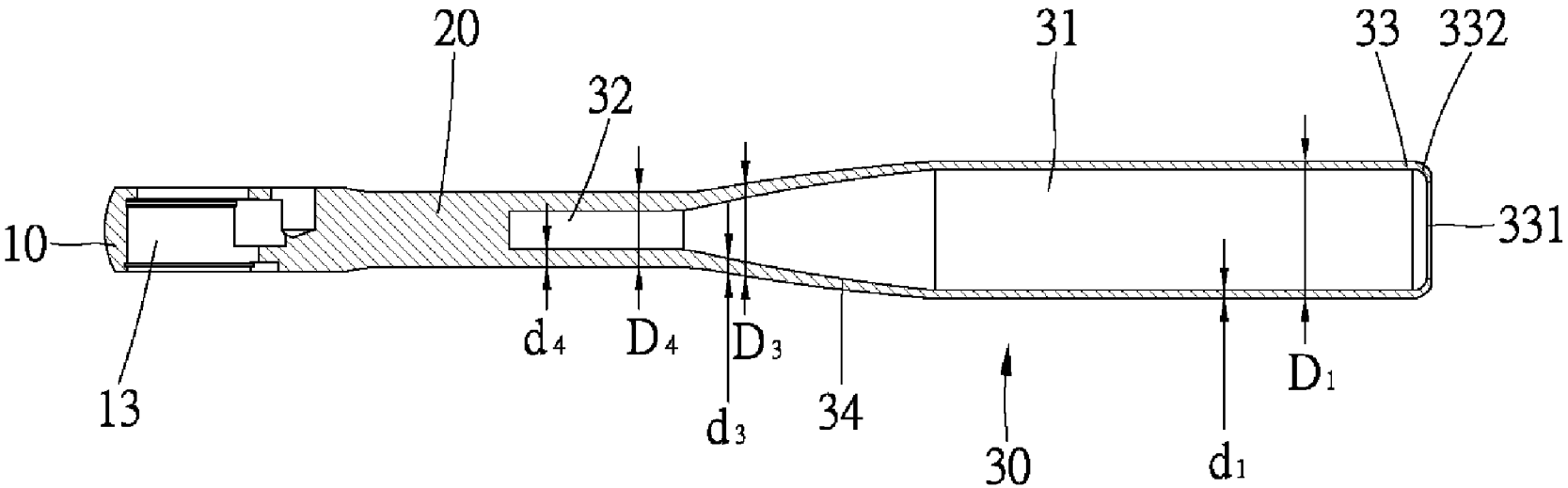
FIG. 12 is a sectional view illustrating an eighth embodiment of the wrench according to the preferred teachings of the present invention.

FIG. 12 is a sectional view illustrating an eighth embodiment of the wrench according to the preferred teachings of the present invention modified from the second embodiment shown in FIGS. 3 through 5, wherein the head portion 10, the neck portion 20, and the handle portion 30 are integrally formed.

Figure 13:
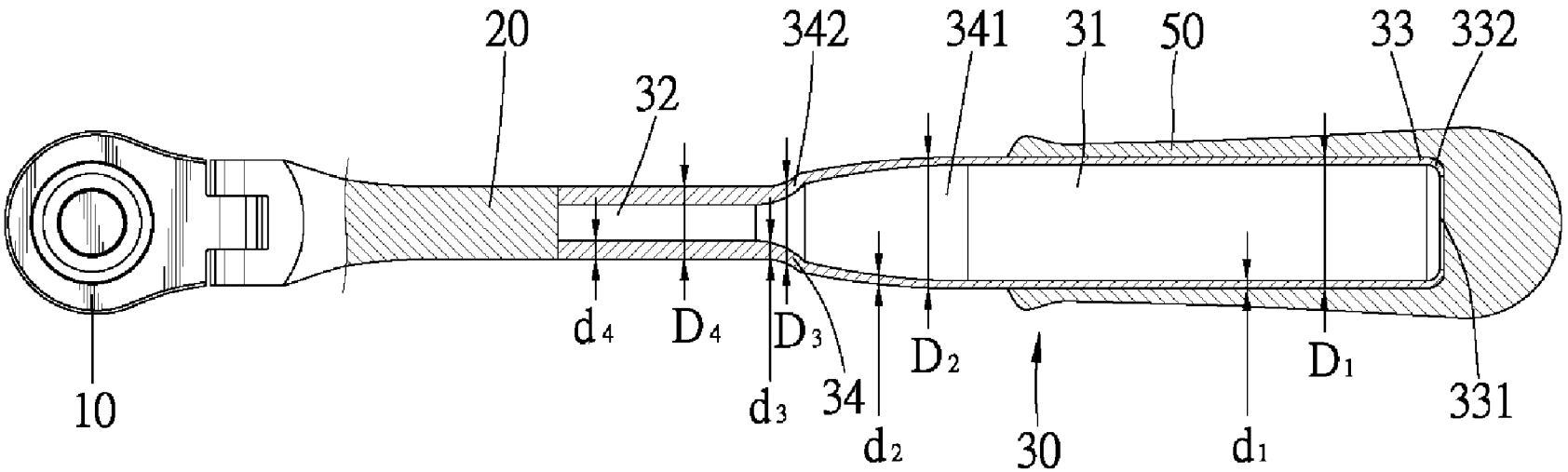
FIG. 13 is a sectional view illustrating a ninth embodiment of the wrench according to the preferred teachings of the present invention.
Figure 14:
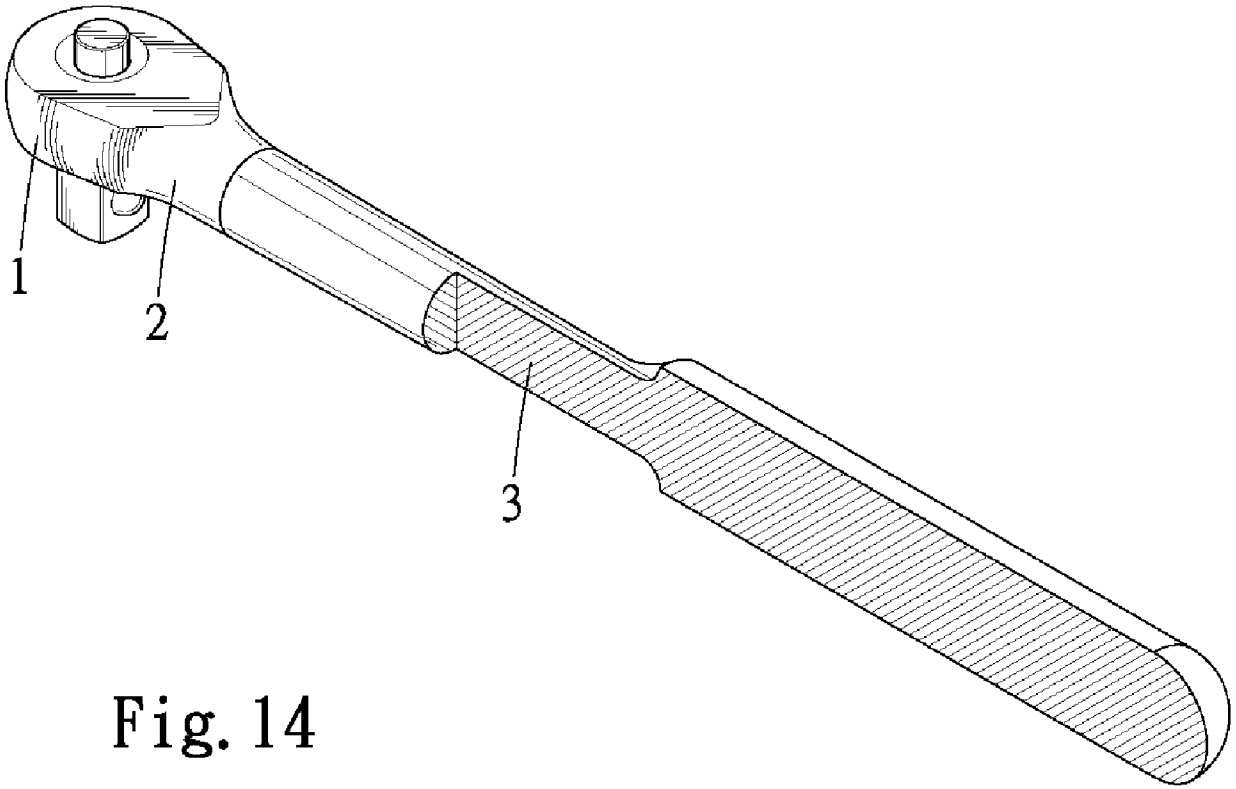
Fig. 14 PRIOR ART
FIG. 14 is a partly-cutaway perspective view of a conventional wrench having a solid handle.
Figure 15:
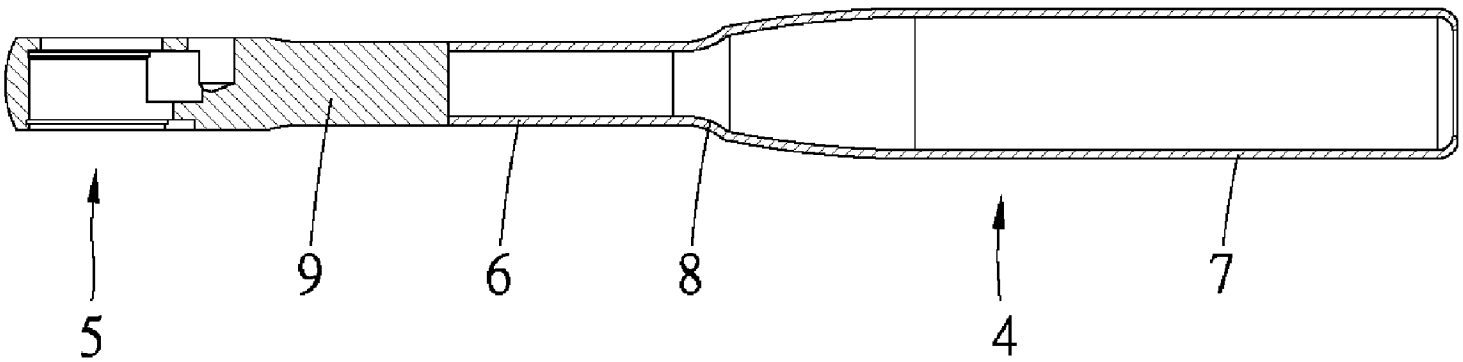
Fig. 15 PRIOR ART
FIG. 15 is a sectional view of another conventional wrench having a hollow handle.

FIG. 13 is a sectional view illustrating a ninth embodiment of the wrench according to the preferred teachings of the present invention, wherein the head portion 10 has an end pivotally connected to the neck portion 20, and an outer cover 50 is mounted to the rear portion 31 of the handle portion 30.

It can be appreciated that the hollow handle according to the preferred teachings of the present invention can be used for various types of wrenches, including but not limited to those illustrated in the drawings. It can be further appreciated that these wrenches can be manufactured by any suitable methods without departing from the teachings of the present invention.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A wrench comprising a head portion, a handle portion, and a neck portion between the head portion and the handle portion, with the head portion being solid, with the handle portion being hollow and including a front portion contiguous to the neck portion, a rear portion adapted to be gripped by a user and a necking portion between the front and rear portions, and with the front portion having a wall thickness greater than that of the rear portion, and with the necking portion having a wall thickness greater than that of the rear portion and smaller than that of the front portion;

wherein the rear portion of the handle portion includes an open rear end defining a rear end opening, with an annular extension extending rearward from a circumference of the rear end and bent inwardly as to define a hole;

wherein the front portion, the neck portion, the rear portion and the rear end of the handle portion are integrally formed as a single and inseparable component of a same material.

2. The wrench as claimed in claim 1, with the necking portion including a small gradient section having a rear end contiguous to the rear portion and a front end, with the necking portion further including a larger gradient section having a rear end contiguous to the front end of the small gradient section and a front end contiguous to the front portion of the handle portion, with the small gradient section including an outer periphery having a first tapering gradient from the rear end thereof to the front end thereof, with the larger gradient section including an outer periphery having a second tapering gradient from the rear end thereof to the front end thereof, with the second tapering gradient being greater than the first tapering gradient.

3. The wrench as claimed in claim 2, with the small gradient section having a wall thickness greater than that of the rear portion, with the larger gradient section having a wall thickness greater than that of the small gradient section and smaller than that of the front portion.

4. The wrench as claimed in claim 2, with the small gradient section having increased wall thickness from the rear end thereof toward the front end thereof.

5. The wrench as claimed in claim 3, with the small gradient section having increased wall thickness from the rear end thereof toward the front end thereof.

6. The wrench as claimed in claim 2, with the larger gradient section having increased wall thickness from the rear end thereof toward the front end thereof.

7. The wrench as claimed in claim 3, with the larger gradient section having increased wall thickness from the rear end thereof toward the front end thereof.

8. The wrench as claimed in claim 4, with the larger gradient section having increased wall thickness from the rear end thereof toward the front end thereof.

9. The wrench as claimed in claim 5, with the larger gradient section having increased wall thickness from the rear end thereof toward the front end thereof.

10. The wrench as claimed in claim 1, further including, in combination: an outer cover mounted around the rear portion of the handle portion.

11. The wrench as claimed in claim 1, further including, in combination: a cap mounted to and covering the hole of the annular extension.

12. The wrench as claimed in claim 1, with the neck portion including a groove in an end face thereof and in communication with an interior of the hollow handle portion.

13. The wrench as claimed in claim 2, with the neck portion including a groove in an end face thereof and in communication with an interior of the hollow handle portion.

14. The wrench as claimed in claim 1, with the necking portion having an outer diameter lesser than that of the rear portion, and with the front portion having an outer diameter lesser than that of the necking portion.

15. The wrench as claimed in claim 2, with the small gradient section having an outer diameter lesser than that of the rear portion, with the larger gradient section having an outer diameter lesser than that of the small gradient section, and with the front portion having an outer diameter lesser than that of the larger gradient section.

16. The wrench as claimed in claim 3, with the small gradient section having an outer diameter lesser than that of the rear portion, with the larger gradient section having an outer diameter lesser than that of the small gradient section, and with the front portion having an outer diameter lesser than that of the larger gradient section.

* * * * *